US007524166B2

(12) United States Patent
Thiele et al.

(10) Patent No.: US 7,524,166 B2
(45) Date of Patent: Apr. 28, 2009

(54) COMPRESSOR CLEANING SYSTEM

(75) Inventors: Martin Thiele, Remingen (CH); Henning Fuhrmann, Zurich (CH); Ralf Strumpler, Erding (DE); Joachim Glatz-Reichenbach, Tägerwilen (CH)

(73) Assignee: ABB Research Ltd, Zurich (CH)

( * ) Notice: Subject to any disclaimer, the term of this patent is extended or adjusted under 35 U.S.C. 154(b) by 245 days.

(21) Appl. No.: 11/389,109

(22) Filed: Mar. 27, 2006

(65) Prior Publication Data

US 2006/0245913 A1 Nov. 2, 2006

Related U.S. Application Data

(63) Continuation of application No. PCT/CH2004/000597, filed on Sep. 22, 2004.

(60) Provisional application No. 60/505,716, filed on Sep. 25, 2003.

(51) Int. Cl.
*F04D 31/00* (2006.01)

(52) U.S. Cl. ..... 415/173.1; 415/173.4; 415/200; 415/208.3; 415/211.2; 415/915

(58) Field of Classification Search ..... 415/200, 415/173.1, 173.4, 177, 178, 915, 208.1, 208.3, 415/211.1, 211.2
See application file for complete search history.

(56) References Cited

U.S. PATENT DOCUMENTS

| | | | | |
|---|---|---|---|---|
| 2,786,626 | A * | 3/1957 | Redcay | 415/116 |
| 3,337,427 | A * | 8/1967 | Whitfield et al. | 205/191 |
| 3,369,533 | A | 2/1968 | de Pietro | |
| 4,196,020 | A | 4/1980 | Hornak et al. | |
| 4,695,224 | A | 9/1987 | Lown | |
| 5,079,100 | A * | 1/1992 | Descamp et al. | 428/552 |
| 5,385,014 | A | 1/1995 | Rathbun | |
| 5,985,454 | A * | 11/1999 | McMordie et al. | 428/413 |
| 6,220,234 | B1 * | 4/2001 | Baker et al. | 415/200 |
| 6,341,747 | B1 * | 1/2002 | Schmidt et al. | 416/224 |

FOREIGN PATENT DOCUMENTS

| | | |
|---|---|---|
| EP | 0 566 476 A1 | 10/1993 |
| FR | 1 563 749 | 4/1969 |

* cited by examiner

*Primary Examiner*—Igor Kershteyn
(74) *Attorney, Agent, or Firm*—Buchanan Ingersoll & Rooney PC

(57) ABSTRACT

A compressor includes a compressor wheel, a diffuser and a device for the wet cleaning of the diffuser of a compressor, the diffuser being arranged downstream of the compressor wheel in the flow direction of the medium to be compressed. The device includes an arrangement for injecting a liquid, which is arranged in such a way that the liquid can be introduced, downstream of the compressor wheel, to the diffuser. The diffuser has at least partially a non-stick coating. A device of this type is suitable for removing deep-seated deposits from the surface of the diffuser.

20 Claims, 3 Drawing Sheets

COMPRESSOR CLEANING SYSTEM

TECHNICAL FIELD

A compressor is disclosed, along with a device and method for the wet cleaning of the diffuser of the compressor.

PRIOR ART

The use of exhaust gas turbochargers for increasing the power of internal combustion engines is nowadays widespread. The exhaust gas turbine of the turbocharger is acted upon by the exhaust gases from the internal combustion engine and its kinetic energy is used for the suction intake and compression of air for the internal combustion engine. As a result of compression, the temperature and pressure of the air rise. Temperatures of 180° C. or higher may thereby occur at the guide blades of the diffuser and at the diffuser walls.

Owing to the suction intake of polluted air, impurities on that side of the gas inlet casing which faces the medium to be compressed may be precipitated on the compressor wheel or the diffuser. If the impure air also contains oil particles, the oil particles become increasingly deep-seated on account of the low surface tension of oil. Above 150° C., the highly volatile constituents of the oil evaporate. At temperatures of about 180 to 260° C., carbonization additionally occurs. These effects lead to residues on the surfaces of the walls. The residues form a thick layer with a rough surface. The efficiency of compressor may thereby decrease by several percent within a short time.

This problem arises to an increased extent in internal combustion engines with crankcase ventilation. In supercharged internal combustion engines, combustion gases between piston rings and liner pass over into the crankcase. Moreover, air enters the crankcase via the oil recirculation line of the turbocharger. These gases are designated as blow-by gases. So that the pressure in the crankcase does not rise excessively, the blow-by gases are discharged, supplied to the suction-intake air upstream of the compressor wheel and compressed, together with the suction-intake air, in the compressor. The blow-by gases contain oil particles which typically have a diameter of 0.1 to 10 μm (micrometers) and are present in a concentration of 5 to 10 mg/m$^3$.

In order to avoid the effects initially mentioned, compressors are regularly cleaned. Cleaning is carried out under part load. The compressor wheel is rotated at a reduced rotational speed and a liquid is supplied, upstream of the compressor wheel, to the flow.

A device of the type initially mentioned is known from the publication U.S. Pat. No. 4,196,020. This proposes to connect a removable cleaning spray device to the gas inlet casing of a gas turbine for cleaning purposes. The cleaning spray device also comprises collecting lines with spray nozzles. For cleaning, the device is placed onto the gas inlet casing, the gas turbine is switched on and a liquid for cleaning is sprayed uniformly via spray nozzles onto that side of the gas inlet casing which faces the medium to be compressed and onto the compressor wheel. By means of this cleaning spray device, therefore, mainly the compressor wheel is cleaned. Deep-seated deposits in the diffuser which does not move are scarcely removed by the finely sprayed liquids. Moreover, part of the sprayed water evaporates even on the moving blades and the gas inlet casing which have been heated as a result of the operation of the compressor, and therefore the diffuser is cleaned only inadequately. Moreover, the operation of the compressor has to be interrupted before and after each cleaning operation, in order to place the cleaning spray device onto the compressor and, after cleaning has taken place, to remove it again.

U.S. Pat. No. 5,385,014 describes a method for cleaning a compressor of an aircraft. The compressor wheel is cleaned in that an aqueous liquid is sprayed upstream of the compressor wheel and the compressor wheel is rotated at a low rotational speed, without ignition being started. As in the method described above too, mainly the compressor wheel is cleaned. Cleaning cannot be carried out during normal operation, since the compressor wheel has to be rotated at a low rotational speed, because pronounced erosion at the corners and edges of the compressor wheel would otherwise occur even with water droplets which are so small.

PRESENTATION OF THE INVENTION

An object of the present invention is, therefore, to specify a compressor with a device for the wet cleaning of a diffuser of the compressor, said device being suitable for removing deep-seated deposits from the surface of the diffuser, and to specify a method for this.

A compressor is disclosed herein, along with a device and method for the wet cleaning of a diffuser of the compressor.

According to the invention, in the compressor, means are provided by which a liquid can be introduced in the flow duct, downstream of the compressor wheel, into the diffuser. Cleaning can be carried out while the compressor is operating at the full rotational speed. Advantageously, the operation of the compressor does not need to be reduced or even interrupted, in order to carry out the cleaning of the diffuser.

The diffuser is provided with a dirt-repelling coating, so that the impurities adhere less firmly to the surface of the diffuser and can therefore be removed more easily by the liquid for cleaning.

In one embodiment, the liquid for cleaning is water. If the device for cleaning a diffuser is used in an exhaust gas turbocharger of an internal combustion engine, there is the advantage that, after cleaning, the water passes into the combustion chambers of the internal combustion engine, and water does not trigger any chemical reactions with elements of the combustion chambers, such as, for example, lubricating films in the cylinders of the internal combustion engine.

In a further embodiment, cold liquid is used for cleaning. The liquid should be in a temperature range between room temperature (e.g. 10° C.) up to 100° C. As there is a high temperature difference between the hot diffuser and the cold liquid, there is a thermal shock, when the liquid impinges on the diffuser. This causes stresses in the diffuser, thereby the deep-seated deposits from the surface of the diffuser come loose and can easily be removed by the liquid jet.

In one embodiment, the device for cleaning the diffuser contains at least one orifice through which the liquid for cleaning can be introduced into the diffuser.

Each guide blade forms with part of a diffuser wall in each case a diffuser duct. The at least one orifice may be arranged in such a way that liquid for cleaning can be supplied to each diffuser duct from at least one orifice. The advantage of this embodiment is that the cleaning of all the parts of the diffuser takes place uniformly.

In a further embodiment, the at least one orifice has connected to it at least one liquid line which is connected in turn to a pump. Via the pump, a liquid pressure can be built up by means of which the liquid can be introduced into the flow duct.

If there are unused cavities, sprues or ducts in the compressor, bores may be provided, starting from these, as far as the flow duct downstream of the compressor wheel, and a liquid for cleaning can be introduced into the diffuser through said bores. The advantage of this version is that existing components can be used in order to produce the device for cleaning the diffuser and such a solution can be retrofitted in an existing compressor.

In a further embodiment, a pump presses the liquid for cleaning, under pressure, through lines which connect the pump to the orifices. The liquid is introduced from the orifices into the flow duct at a pressure which is higher than the pressure prevailing in the flow duct. The cleaning liquid impinges onto that side of the diffuser walls which faces the medium to be compressed and/or onto the guide blades and removes the deposits there. In one variant, the pressure is only such that the liquid flows along the diffuser walls and/or the guide blades. The pressure may also be increased to an extent such that the liquid splashes against the walls and/or the guide blades. The liquid can thereby be splashed in a controlled manner onto parts of the diffuser, and the pressure of the liquid can assist the cleaning of the diffuser.

Further advantageous variants and embodiments may be gathered from the dependent patent claims.

BRIEF DESCRIPTION OF THE DRAWINGS

The method according to the invention and the subject of the invention are explained in more detail below with reference to a preferred exemplary embodiment which is illustrated in the accompanying drawings, in which.

Figure 1:
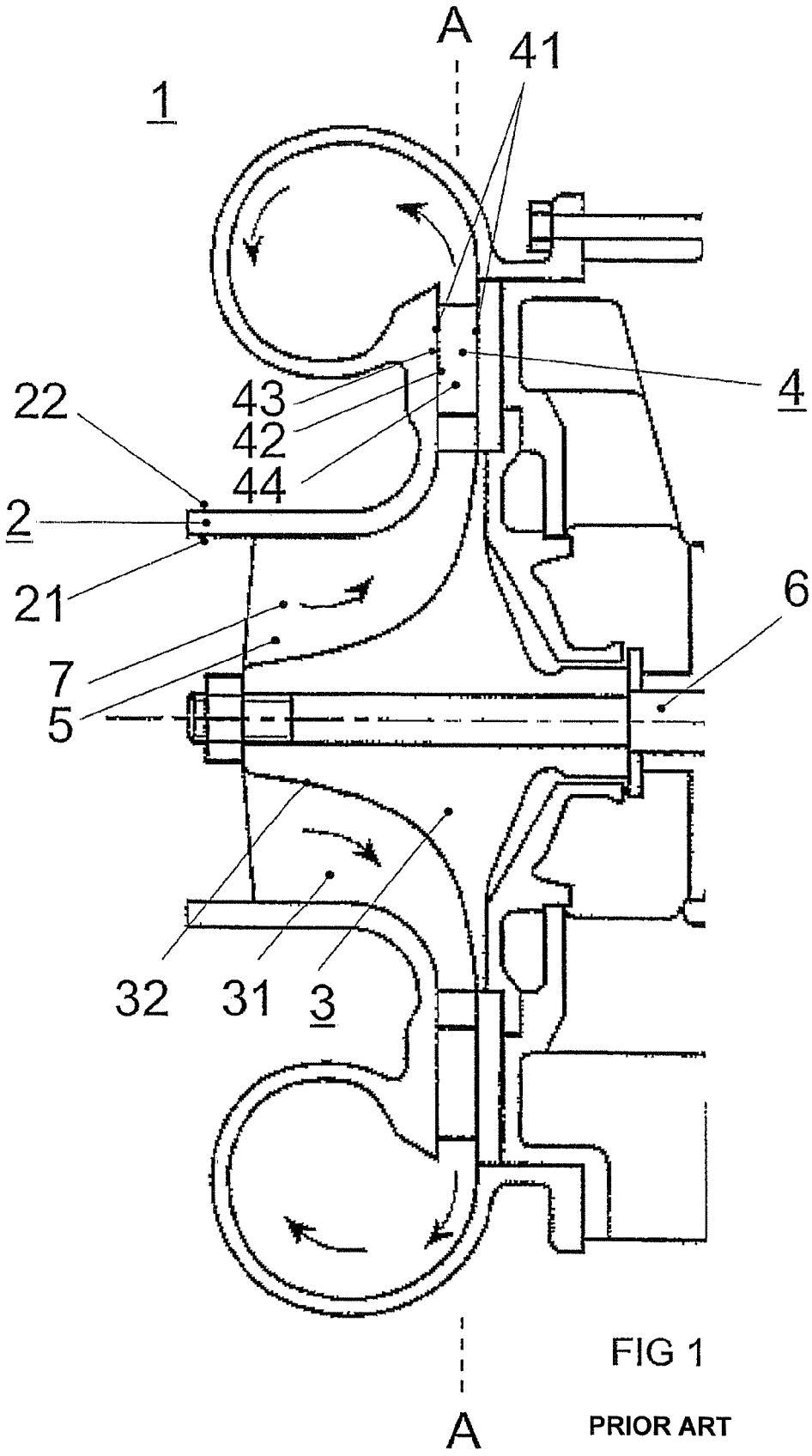
FIG 1 PRIOR ART
FIG. 1 shows, in a section along its machine axis, a detail of a turbocharger with a compressor according to the prior art.

The reference symbols used in the drawings and their significance are listed together in the list of reference symbols. Basically, identical parts are given the same reference symbols in the figures. The embodiments described are examples of the subject of the invention and have no restrictive defect.

WAYS OF IMPLEMENTING THE INVENTION

FIG. 1 shows, in a section along the machine axis of a turbocharger, a compressor side detail of a turbocharger with a compressor (1). The compressor (1) has a gas inlet casing (2), a compressor wheel mounted on a shaft (6), with moving blades (31) and a hub (32), and also a diffuser (4). A turbine wheel (not illustrated in the figure) is likewise mounted on the shaft (6). The gas inlet casing (2) has an inside (21) which faces the medium to be compressed and along which the medium to be compressed flows, and an outside (22) which faces away from the medium to be compressed and which lies further away from the shaft. A flow duct (5) is delimited outwardly by the inside of the gas inlet casing and inwardly by the hub (32) of the compressor wheel (3). The flow direction (7) of the medium to be compressed goes along the flow duct (5) from the orifice of the gas inlet casing in the direction of the diffuser (4) (illustrated by arrows in FIG. 1). Downstream of the moving blades, the gas inlet casing (2) merges in to a diffuser wall (41) of the diffuser (4). The diffuser comprises guide blades (44) and diffuser walls (41), each diffuser wall (41) having an inside (42) which faces the medium to be compressed and which delimits the flow duct outwardly, and an outside (43) which faces away from the medium to be compressed and which lies opposite each inside (42) of the diffuser walls.

The diffuser (4) is at least partially provided with a non-stick coating. A coating of this type may also be provided on the inside (21) of the gas inlet casing and on the compressor wheel (3). The coating should be permanently temperature-resistant up to temperatures such as occur while the compressor is in operation. Typically, in diffusers of compressors, temperatures of up to 260° C. are generated, and the coating should also be suitable for a short-term temperature rise up to 290° C. In special applications or in future turbochargers, however, even higher temperatures are conceivable and coatings with a correspondingly higher resistance are required.

Depending on the soiling which occurs and on the field of use of the compressor, it may be advantageous if the coating is water-repellant and/or oil-repellant. If the suction-intake air also contains etching substances which attack the walls, a coating may be selected which is also corrosion-resistant.

A suitable coating is a polymeric nanocomposite which consists of a polymeric coating with a fluorine-containing surface and with embedded hard particles, the size of which lies in the nanometer range. A coating consisting of perfluoroalkoxy copolymer (Teflon PFA), hard-chrome coatings or nickel platings are also possible. This list is in no way to be conclusive.

Figure 2:
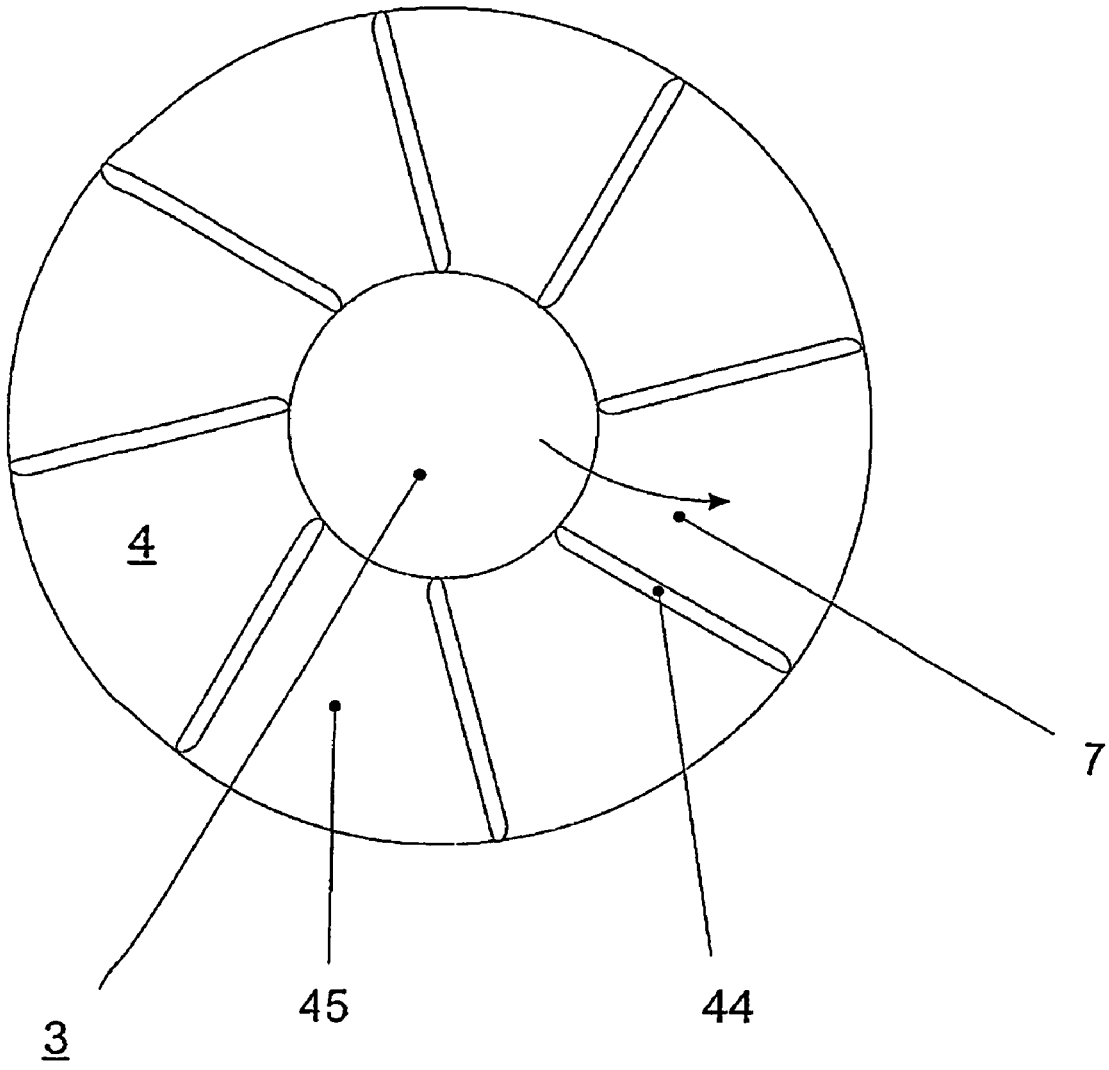
FIG. 2 shows a top view of the diffuser (section through the plane A-A from FIG. 1)

FIG. 2 shows a top view of a diffuser as a section through the plane A-A from FIG. 1. In the diffuser (4), diffuser ducts (45) are formed, which are delimited in each case by two guide blades (44) and part of a diffuser wall (41). The guide blades (44) may be directly contiguous to the moving blades of the compressor wheel, but it is also possible for a radially extensive gap to be provided between the moving blades and the guide blades.

The device according to the invention for the wet cleaning of a diffuser is located downstream of the compressor wheel (3). It is arranged in such a way that the liquid for cleaning can be introduced, downstream of the compressor wheel (3), into the diffuser (4). In the gas inlet casing (2) and/or in at least one diffuser wall (41), at least one orifice is provided, which is designed as a bore and passes through the wall. The at least one bore goes from the inside (21) of the gas inlet casing to an outside (22) of the gas inlet casing and/or from the inside (42) of the at least one diffuser wall to the outside (43) of the at least one diffuser wall.

The at least one orifice is arranged near the stagnation point of the diffuser. When the medium to be compressed leaves the moving blades, its velocity is high. Just in front of the diffuser the medium to be compressed is slowed down, i.e. its velocity is reduced. The at least one orifice is arranged in the region, in which the medium has reduced velocity. In case of a diffuser with guide blades (44) the lowest velocity is in the stagnation point, which is just in front of the leading edge of each guide blade (44). The advantage of the at least one orifice being arranged near the stagnation point is that in this point the liquid jet needs a low velocity to enter the flow duct (5) and to reach on to at least one diffuser wall (41) and/or the guide blades (44) compared to an orifice arranged at a point, at which the medium has a higher velocity.

In one embodiment, the diffuser (4) has no guide blades. In these diffusers (4), the cross section of the diffuser, which is delimited by the inside (42) of the diffuser walls, increases in the flow direction (7).

The at least one orifice may be arranged in such a way that liquid can be supplied to each diffuser duct from at least one orifice.

In one variant of the device according to the invention, the at least one orifice has a round cross section, but orifices with other cross sections may also be envisaged. These may be, for example, oval, square or rectangular cross sections.

In one embodiment, the cross section of the at least one bore is invariable along the longitudinal axis of the bores. However, the cross section of the at least one bore may also narrow from the outside (22) of the gas inlet casing and/or the outside (43) of at least one diffuser wall to the inside (21) of the gas inlet casing and/or at least one diffuser wall (42), so that the liquid for cleaning is accelerated in the bore toward the flow duct.

The size of the at least one orifice may be selected as a function of the pressure at which the liquid is to be conveyed into the flow duct (5).

When liquid is the supplied to the diffuser (4) from a plurality of orifices, the orifices may be located in one cross-sectional plane of the diffuser (4). In one variant, the orifices are arranged in various cross-sectional planes of the diffuser (4), so that the liquid for cleaning can be supplied in a controlled manner to various regions of the diffuser (4), such as, for example, to the downstream end region.

The at least one bore is connected, on the outside (43) of the diffuser wall, to at least one liquid line. This at least one liquid line may issue into a collecting line which is connected to a pump (not illustrated in the figure) or the at least one liquid line may be connected directly to the pump.

In one embodiment of the invention, the longitudinal axis of the bores is perpendicular to the surface of that part of the gas inlet casing (2) and/or of the diffuser wall (41) which surrounds them.

In a further embodiment, the longitudinal axis of the at least one bore forms with the inside of that part of the gas inlet casing (2) which surrounds them and/or with the inside of the at least one diffuser wall (41) an angle which is unequal to 90°. What is achieved thereby is that the liquid for cleaning impinges obliquely onto the inside (42) of the diffuser walls and/or onto the inside (21) of the gas inlet casing. In the event that liquid can be supplied to each diffuser duct from a plurality of orifices, the angles between the longitudinal axis of the bore and the inside of the that part of the gas inlet casing and/or of the at least one diffuser wall which surrounds it may vary. In this case, the longitudinal axes of the bores may be designed in such a way that the liquid for cleaning can be introduced into the diffuser (4) in a fan-shaped manner.

Water may be used as the liquid for cleaning. Additives which reinforce the cleaning process may also be added to the water.

The extent of carbonization may be reduced by cooling the walls of the compressor on which carbonization takes place. Owing to the lower temperatures on the walls, the carbonization layer builds up less quickly and adheres less firmly to the walls and can therefore be removed more easily. The cooling of the walls may take place by means of existing cavities in the compressor or cavities or cooling hoses provides specially for this purpose. Cooling may be achieved by means of air, water or oil.

In the method according to the invention for cleaning a diffuser (4) of a compressor (1), air is sucked in by a compressor wheel (3). In addition, impure air can be supplied to the suction-intake air from a blow-by duct.

For cleaning the diffuser (4), a liquid pressure is built up by a pump. The liquid is pressed by the pump through a collecting line to the orifices in the gas inlet casing (2) and/or the at least one diffuser wall (41). The pressure necessary for this purpose is higher than the pressure prevailing in the flow duct (5) of the compressor. The liquid is introduced into the flow duct (5) and thus passes on to at least one diffuser wall (41) and/or the guide blades (44).

The liquid can be introduced into the diffuser (4) in such a way that, downstream of the orifice, it flows along on the inside (42) of the diffuser wall and/or the guide blades (44). In a preferred embodiment of the invention the pressure of the liquid is sufficient high so that the liquid jet enters the flow duct (5), passes the flow duct (5) and impinges on the inside (21) of the gas inlet casing, the inside (42) of the diffuser wall and/or the guide blades (44). When impinging the liquid jet still has a velocity component perpendicular to the area, on which it impinges, which velocity component is greater than zero.

Compressors which are operated in exhaust gas turbochargers of an internal combustion engine may be equipped with an auxiliary air drive system which makes it easier to start an internal combustion engine. For this purpose, air is introduced, upstream of the diffusers, into an annular chamber through supply lines by means of a pump and is led into the flow duct via bores in the gas inlet casing. If such a system is not used as an auxiliary air drive system, the bores in the gas inlet casing may be sealed off and new bores be drilled in such a way that a liquid for cleaning can be introduced, downstream of the compressor wheel, into the diffuser. The liquid for cleaning is transported through the supply lines into the annular chamber and is introduced into the diffuser at a pressure which is higher than the pressure prevailing in the flow duct of the compressor.

Figure 3:
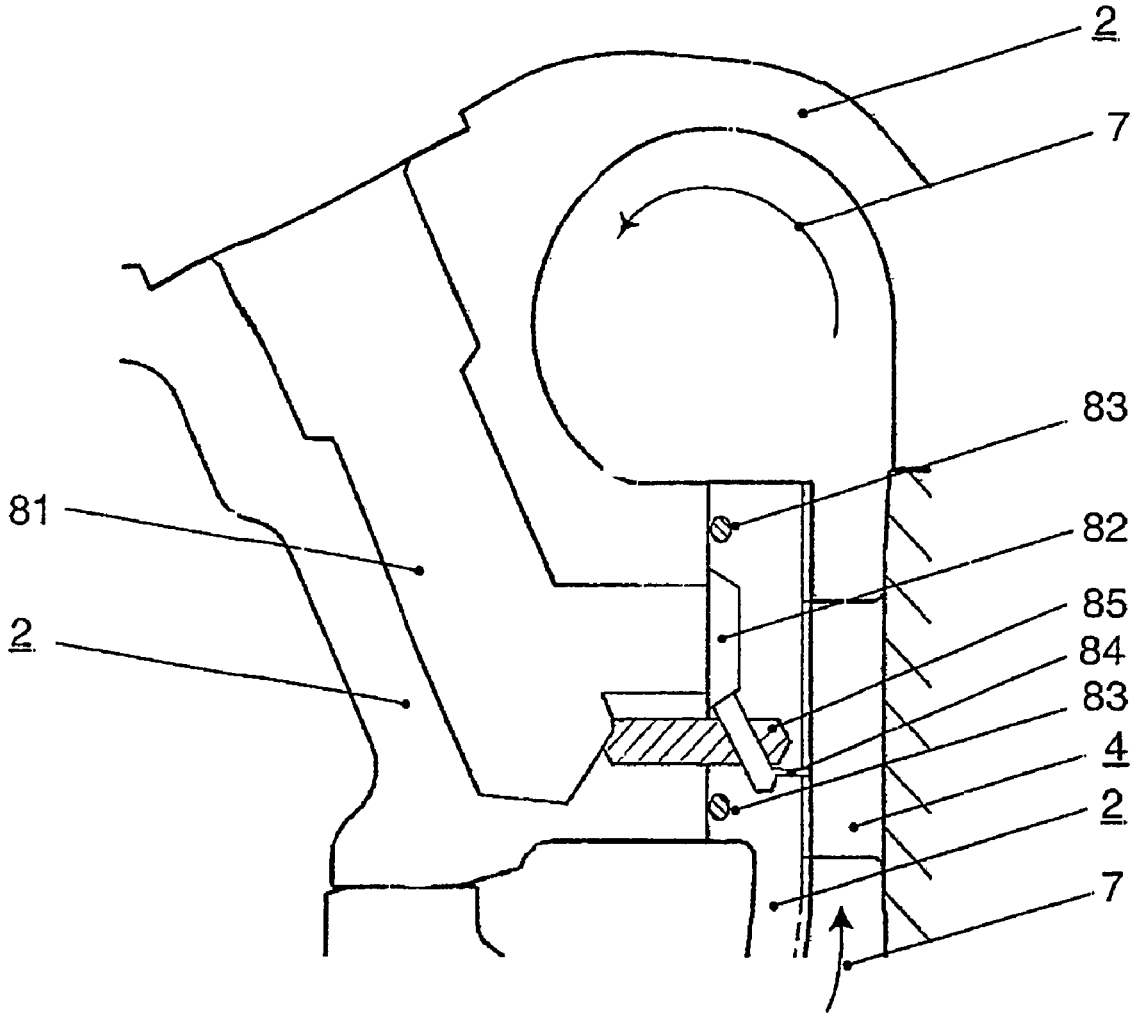
FIG. 3 shows a detail of a compressor with a diffuser and a device for cleaning a diffuser in the case of a subsequent mounting of the device for cleaning into an existing compressor.

Even other existing cavities, sprues or ducts not required for other purposes may be utilized for the introduction of liquids into the diffuser. It is also possible, however, to produce such cavities. FIG. 3 shows a duct (81) connected to an annular chamber (82) which runs around the compressor wheel, parallel to the diffuser (4).

Sealing means (83) seal off this chamber relative to the gas inlet casing (2). Bores (84) extend from the annular chamber as far as the diffuser (4). To fix the positions of the parts in the circumferential direction, bolts or other fixing means (85) are provided. A liquid is introduced through the duct (81) into the annular chamber (82) and is supplied to the diffuser (4) from there.

LIST OF REFERENCE SYMBOLS

1 Compressor
2 Gas inlet casing
21 Inside of the gas inlet casing
22 Outside of the gas inlet casing
3 Compressor wheel
31 Moving blades
32 Hub
4 Diffuser
41 Diffuser wall
42 Inside of the diffuser wall
43 Outside of the diffuser wall
44 Guide blades
45 Diffuser duct
5 Flow duct
6 Shaft
7 Flow direction
81 Duct
82 Annular chamber
83 Sealing means
84 Bore
85 Fixing means

The invention claimed is:

1. A compressor, comprising:

a compressor wheel, a diffuser, and a device for the wet cleaning of the diffuser of the compressor, the diffuser being arranged downstream of the compressor wheel in a flow direction of a medium to be compressed, the diffuser having at least partially a non-stick coating and the device comprising a liquid jet which is directed out of a region downstream of the compressor wheel onto that part of the diffuser which is to be cleaned.

2. The compressor as claimed in claim 1, wherein the liquid jet is directed, during the operation of the compressor, onto that part of the diffuser which is to be cleaned.

3. The compressor as claimed in claim 1, wherein the compressor comprises a gas inlet casing, and the diffuser comprises diffuser walls, and the device has at least one orifice which is arranged in the gas inlet casing and/or at least one diffuser wall and through which in each case a liquid jet is conveyed into the diffuser.

4. The compressor as claimed in claim 2, wherein the compressor comprises a gas inlet casing, and the diffuser comprises diffuser walls, and the device has at least one orifice which is arranged in the gas inlet casing and/or at least one diffuser wall and through which in each case a liquid jet is conveyed into the diffuser.

5. The compressor as claimed in claim 3, wherein the diffuser comprises guide blades and diffuser ducts, each diffuser duct being delimited by a guide blade and part of a diffuser wall, and in each case a liquid jet being directed onto each diffuser duct from at least one orifice.

6. The compressor as claimed in claim 4, wherein the diffuser comprises guide blades and diffuser ducts, each diffuser duct being delimited by a guide blade and part of a diffuser wall, and in each case a liquid jet being directed onto each diffuser duct from at least one orifice.

7. The compressor as claimed in claim 3, wherein orifices are designed as bores in that side of the gas inlet casing and/or that side of at least one on the diffuser walls which faces the medium to be compressed and have a longitudinal axis which is perpendicular to the side, facing the medium to be compressed, of that part of the gas inlet casing diffuser wall which surrounds them.

8. The compressor as claimed in claim 4, wherein the orifices are designed as bores in that side of the gas inlet casing and/or that side of at least one of the diffuser walls which faces the medium to be compressed and have a longitudinal axis which is perpendicular to the side, facing the medium to be compressed, of that part of the gas inlet casing or diffuser wall which surrounds them.

9. The compressor as claimed in 1, wherein the coating is permanently heat-resistant.

10. The compressor as claimed in 1, wherein the coating is a polymeric nanocomposite.

11. The compressor as claimed in 9, wherein the coating is a polymeric nanocomposite.

12. The compressor as claimed in claim 1, wherein the coating is a perfluoroalkoxy copolymer.

13. The compressor as claimed in claim 9, wherein the coating is perfluoroalkoxy copolymer.

14. The compressor as claimed in 1, wherein the coating is a hard-chrome coating.

15. The compressor as claimed in 1, wherein the coating is a nickel plating.

16. The compressor as claimed in claim 1, wherein the compressor comprises a gas inlet casing, and the diffuser comprises diffuser walls, and means for cooling the walls are provided in the gas inlet casing and/or at least one diffuser wall.

17. A turbocharger, containing a compressor as claimed in claim 1.

18. A compressor, comprising:

a compressor wheel, a diffuser, and a device for the wet cleaning of the diffuser of the compressor, the diffuser being arranged downstream of the compressor wheel in a flow direction of a medium to be compressed, the diffuser having at least partially a non-stick coating and the device comprising a liquid jet which is directed out of a region downstream of the compressor wheel onto that part of the diffuser which is to be cleaned, wherein the compressor comprises a gas inlet casing, and the diffuser comprises diffuser walls, and the device has at least one orifice which is arranged in the gas inlet casing and/or at least one diffuser wall and through which in each case a liquid jet is conveyed into the diffuser, wherein the diffuser comprises guide blades and diffuser ducts, each diffuser duct being delimited by a guide blade and part of a diffuser wall, and in each case a liquid jet being directed onto each diffuser duct from at least one orifice, and wherein at least one orifice is arranged close to a stagnation point of a guide blade.

19. A compressor, comprising:

a compressor wheel a diffuser, and a device for the wet cleaning of the diffuser of the compressor, the diffuser being arranged downstream of the compressor wheel in a flow direction of a medium to be compressed, the diffuser having at least partially a non-stick coating and the device comprising a liquid jet which is directed out of a region downstream of the compressor wheel onto that part of the diffuser which is to be cleaned, wherein the liquid jet is directed, during the operation of the compressor, onto that part of the diffuser which is to be cleaned, wherein the compressor comprises a gas in let casing, and the diffuser comprises diffuser walls, and the device has at least one orifice which is arranged in the gas inlet casing and/or at least one diffuser wall and through which in each case a liquid jet is conveyed into the diffuser, wherein the diffuser comprises guide blades and diffuser ducts, each diffuser duct being delimited by a guide blade and part of a diffuser wall, and in each case a liquid jet being directed onto each diffuser duct from at least one orifice, and wherein at least one orifice is arranged close to a stagnation point of a guide blade.

20. A method for cleaning a diffuser with a liquid, wherein a liquid jet is injected into a flow duct from an orifice lying downstream of a compressor wheel, the liquid jet being deflected as a function of a flow in the flow duct, and wherein a pressure of the liquid jet is selected such that the liquid jet impinges onto that part of the diffuser which is to be cleaned.

* * * * *